US009950370B2

(12) United States Patent
Roth-Fagaraseanu et al.

(10) Patent No.: US 9,950,370 B2
(45) Date of Patent: Apr. 24, 2018

(54) METHOD FOR MANUFACTURING A PART BY METAL INJECTION MOLDING

(71) Applicant: Rolls-Royce Deutschland Ltd & Co KG, Blankenfelde-Mahlow (DE)

(72) Inventors: Dan Roth-Fagaraseanu, Stahnsdorf (DE); Lukas Schruefer, Berlin (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 794 days.

(21) Appl. No.: 13/720,577

(22) Filed: Dec. 19, 2012

(65) Prior Publication Data

US 2013/0156626 A1 Jun. 20, 2013

(30) Foreign Application Priority Data

Dec. 20, 2011 (DE) ..... 10 2011 089 260

(51) Int. Cl.
*B22F 7/02* (2006.01)
*B22F 7/06* (2006.01)
(Continued)

(52) U.S. Cl.
CPC ..... *B22F 7/02* (2013.01); *B22F 3/225* (2013.01); *B22F 5/04* (2013.01); *B22F 7/06* (2013.01);
(Continued)

(58) Field of Classification Search
CPC ..... B22F 2005/225; B22F 5/04; B22F 7/02
See application file for complete search history.

(56) References Cited

U.S. PATENT DOCUMENTS 4,539,197 A 9/1985 Asaka et al.
4,813,823 A * 3/1989 Bieneck ..... B21C 23/147 408/144
(Continued)

FOREIGN PATENT DOCUMENTS

AT 503442 10/2007
CA 2588626 11/2008
(Continued)

OTHER PUBLICATIONS

Hausner and Roman. "Linear shrinkage of metal powder compacts during sintering." Scientific Principles Of Powder Metallurgy, Soviet Powder Metallurgy and Metal Ceramics, May 1965, vol. 3, Issue 3, pp. 180-184.*
(Continued)

*Primary Examiner* — Keith Walker
*Assistant Examiner* — Stephani Hill
(74) *Attorney, Agent, or Firm* — Shuttleworth & Ingersoll, PLC; Timothy J. Klima

(57) ABSTRACT

A method for manufacturing a part includes metal injection molding of metal powder mixed with a binder to produce individual components of the part as separately molded green compact sections which are then debindered to form brown compact sections. At least one of the brown compact sections is subjected to a pre-sintering process to undergo a first shrinkage. The pre-sintered brown compact section and a further brown compact section are joined together to form a multi-part brown compact which is subsequently subjected to a main sintering process, where the pre-sintered brown compact section undergoes less shrinkage than the further brown compact section to draw together and firmly connect the pre-sintered brown compact section and the further brown compact section.

7 Claims, 3 Drawing Sheets

(51) Int. Cl.
*B22F 3/22* (2006.01)
*B22F 5/04* (2006.01)
*B22F 5/00* (2006.01)

(52) U.S. Cl.
CPC ..... *B22F 7/062* (2013.01); *B22F 2005/005* (2013.01)

(56) References Cited

U.S. PATENT DOCUMENTS

| | | | | |
|---|---|---|---|---|
| 5,487,772 | A | 1/1996 | McCoy | |
| 5,654,106 | A * | 8/1997 | Purnell | B22F 3/26 419/27 |
| 6,033,788 | A | 3/2000 | Cawley et al. | |
| 6,488,887 | B1 | 12/2002 | Arai et al. | |
| 7,744,346 | B2 | 6/2010 | Schreiber et al. | |
| 2005/0036898 | A1 | 2/2005 | Sweetland | |
| 2006/0156843 | A1 * | 7/2006 | Becker | B22F 5/08 74/424.82 |
| 2007/0102572 | A1 | 5/2007 | Bohdal | |
| 2007/0202000 | A1 | 8/2007 | Andrees et al. | |
| 2009/0196761 | A1 | 8/2009 | James | |
| 2009/0304497 | A1 | 12/2009 | Meier | |
| 2010/0008778 | A1 | 1/2010 | Patrick et al. | |
| 2010/0236688 | A1 | 9/2010 | Scalzo et al. | |
| 2011/0020085 | A1 | 1/2011 | Glaser et al. | |

FOREIGN PATENT DOCUMENTS

| | | | |
|---|---|---|---|
| DE | 10053199 | A1 | 5/2001 |
| DE | 10331397 | | 1/2005 |
| DE | 102008042065 | | 3/2010 |
| DE | 102009049695 | | 1/2011 |
| EP | 1801352 | A2 | 6/2007 |
| EP | 2279827 | | 2/2011 |
| GB | 2448031 | A | 10/2008 |
| WO | 2007005632 | | 1/2007 |
| WO | WO2010139571 | A1 | 12/2010 |
| WO | 2012069641 | | 5/2012 |

OTHER PUBLICATIONS

German Search Report dated Jul. 15, 2011 from related DE App No. 102010061958.2.

International Search Report dated Apr. 6, 2012 from related PCT App No. PCT/EP2011/071048.

Schult—U.S. Appl. No. 13/989,631, filed May 24, 2013.

European Search Report dated Apr. 17, 2013 from counterpart European App No. 12198188.0.

* cited by examiner

METHOD FOR MANUFACTURING A PART BY METAL INJECTION MOLDING

CROSS-REFERENCE TO RELATED APPLICATION

This application claims priority to German Patent Application No. 10 2011 089 260.5 filed on Dec. 20, 2011, the entirety of which is fully incorporated herein by reference.

BACKGROUND

This invention relates to a method for manufacturing a part by metal injection molding of metal powder mixed with a binder, by which method individual components of the part are produced as separately molded green compact sections and then as debindered brown compact sections which are joined together to form a two or more part multi-part brown compact and sintered in the assembled state. The method is for example suitable for manufacturing thermally stressed engine parts of geometrically complex structure.

It is known to manufacture parts of high geometrical complexity from different metals, for example special steels, case-hardened and tempered steels, intermetallic phases, light metals on titanium basis and the like, by metal injection molding (MIM), with complete use of the material and with little or no reworking. In metal injection molding, a metal powder is initially mixed with a binder made of thermoplastics and waxes to form a feedstock which is free-flowing and processable in an injection molding process. The binder is then removed from the part, or green compact, created by injection molding by the use of solvents or heat, so that a porous molded part—called the brown compact—is available and has the same dimensions as the green compact. In a subsequent heating process, the brown compact is sintered at slightly below the melting temperature of the respective metal in a sintering furnace, usually in an inert gas atmosphere or sometimes also in a vacuum. After sintering, in which the brown compact shrinks to the required final dimensions, the final molding is obtained. Reworking is generally not necessary.

It is known from DE 103 31 397 A1 to manufacture parts of geometrically complicated shape for an aircraft gas turbine, in this case individual stator vane ring segments each having two or more stator vanes plus an inner shroud section and an outer shroud section, by metal injection molding. With this method, the inner and outer shroud sections are each prefabricated separately as a brown compact and then pre-sintered without shrinkage. The pre-sintered vane and shroud brown compacts are then joined together to form a stator vane segment and fixed relative to one another in the assembled position by clamps, and then sintered. A close contact at the mating surfaces, which is required for making a firm connection between the individual parts, is not assured by the arrangement of clamps. Also, the restricted freedom of movement due to fixing by means of clamps can result in unwelcome deformations and cracks in the assembled stator vane segment during sintering.

US 2007/0202000 A1 describes a method for connecting two components manufactured by metal injection molding, where the two components to be connected have differing shrinkage during sintering. The two components have projections or recesses, respectively, which positively engage in one another. During sintering, the component enclosing the projections of the other component exerts a pressure on these projections. The following connection of the two components is assured primarily by the projections.

SUMMARY

The object underlying the invention is to provide further methods for metal injection molding of geometrically complex parts joined together from separately prefabricated brown compacts, where a close and firm connection is achieved between the assembled brown compacts during the sintering process.

It is provided in accordance with an exemplary embodiment of the invention that at least one of the brown compact sections to be connected is subjected to a pre-sintering process in which it undergoes a first shrinkage. This first shrinkage is however less than the maximum shrinkage that the brown compact section can undergo due to sintering. The at least one pre-sintered and hence pre-shrunk brown compact section and at least one further brown compact section are then joined together to form a two or more part multi-part brown compact. Subsequently, the multi-part brown compact is subjected to a main sintering process, where the at least one pre-sintered brown compact section undergoes less shrinkage than the at least one further brown compact section, whereby the at least one pre-sintered brown compact section and the at least one further brown compact section are firmly connected to one another.

Hence the non-pre-sintered brown compact section shrinks more than the pre-sintered brown compact section, thereby providing pressure on the surfaces to be joined. The more heavily shrinking brown compact section is automatically pressed against the less heavily shrinking brown compact section, so that a zero gap dimension and a close connection are always assured between the brown compact sections. It is also possible in the metal injection molding process to provide parts of complex shape in high quality. The method is, for example, suitable for manufacturing thermally stressed engine parts of geometrically complex structure.

In an exemplary embodiment of the invention, it is provided that a pre-sintered brown compact section and a further brown compact section are connected to one another before the main sintering process by positively engaging connecting elements provided on joining surfaces of the brown compact sections to be connected. It can be provided here that the brown compact section to be pre-sintered has, before being subjected to the pre-sintering process, dimensions such that it cannot be connected to the further brown compact section, and during the pre-sintering process shrinks sufficiently such that the two brown compact sections can now be connected using the engaging connecting elements. The brown compact section to be pre-sintered is thus provided with a connecting element such that a fit with the further brown compact section is only assured after pre-sintering. After fitting, the two parts are then finish-sintered, with the non-pre-sintered part shrinking more than the pre-sintered one.

In this way, even non-rotationally symmetrical brown compact sections can be firmly connected to one another without disruptive aids during the sintering process, and non-rotationally symmetrical parts of complex shape, for example turbine blades provided with shrouds, can be produced by metal injection molding.

The connecting elements of the brown compact sections are, in accordance with an embodiment of the invention, positively engaging projections and recesses. It is provided here that the projections taper towards the main body of the brown compact section and to do so are designed for example in a dovetail or club shape. The recesses of the other brown compact section have a matching and complementary shape.

At least two design variants are possible here. In accordance with a first exemplary design variant, the projections are provided on that brown compact section which is pre-sintered, and the recesses are provided on the further brown compact section. This means that during the main sintering process, the brown compact section having the recesses and enclosing the projections of the other brown compact section exerts a pressure on these projections. The resultant connection of the two components is primarily assured by the projections and is limited substantially to the area of the projections and recesses.

In accordance with a second exemplary design variant, the recesses are provided on that brown compact section which is pre-sintered and the projections are provided on the further brown compact section. This design variant has the effect that during sintering of the assembled brown compact, the brown compact section having recesses is drawn to the brown compact section having projections by its more heavily shrinking projections, whereby the respective contact surfaces between the brown compact sections are pressed against one another. Here the surfaces at which the brown compact sections are drawn against one another during sintering of the assembled brown compact can be arranged substantially parallel to one another, which includes a common curvature.

With this design variant, it is achieved that a high pressure and hence an intensive surface contact of the two brown compact sections is achieved not only in the area of the projections and recesses, but particularly along all the contact surfaces along which the two brown compact sections are in contact with one another. The brown compact sections are in this invention variant pressed against one another during sintering of the assembled brown compact, in other words, over a large area at contact surfaces provided adjacent to the projections and recesses on the brown compact sections.

The projections and recesses of the brown compact sections to be connected are, prior to sintering, brought into positive engagement, for example, by longitudinal displacement or rotation of the brown compact sections to be connected.

In further design variants, the projections have a convex curvature and the recesses a concave curvature, for example, in the form of spherical or club-shaped projections and recesses.

A further exemplary design variant of the invention provides that at least three brown compact sections are joined together and jointly sintered in the main sintering process. One of these brown compact sections is here a connecting part that can be joined together with two further brown compact sections before the main sintering process. The connecting part has to that end two connecting elements, for example in the form of projections or recesses. Now either the brown compact section designed as a connecting part is pre-sintered or the two further brown compact sections are pre-sintered. Then the two further brown compact sections are connected to one another by means of the brown compact section designed as a connecting part for the main sintering process. During the main sintering process, both brown compact sections are closely connected to the brown compact section acting as the connecting part, so that they are closely connected to one another via the connecting part.

The connecting part can here for example be designed as a so-called insert having substantially the shape of two recesses provided in the brown compact sections to be connected. It can be provided here that the connecting part during the main sintering process draws the two other brown compact sections against one another, so that a zero gap dimension is achieved over a wide surface between contact surfaces of the adjacent brown compact sections.

The method in accordance with the invention can also be used for parts of rotationally symmetrical design. It is provided here in one design variant that the assembled brown compact includes an inner brown compact section and an outer brown compact section enclosing the former with or without connecting elements. The outer brown compact section is not the pre-sintered brown compact section here. During the main sintering process, the outer brown compact section is pressed against the inner brown compact section.

It is provided in one design variant that the at least one pre-sintered brown compact section undergoes during pre-sintering a volume shrinkage of at least 2%. This assures the creation during the main sintering process of sufficient compression between the surfaces to be joined.

An advantage of the method in accordance with the present invention is that on the basis of the inventive idea of pre-sintering at least one of the brown compact sections, a different shrinkage of the brown compact sections is achieved during the main sintering process, even if the brown compact sections to be connected consist of the same material and have substantially identical shrinkage properties. Accordingly, the invention in accordance with one embodiment is achieved with sections including or consisting of the same material, having the same binder proportions and hence having substantially identical shrinkage properties. The use of different materials, involving extra expenditure throughout the process sequence and hence increased parts costs, is avoided.

Nevertheless, the invention can in principle also be achieved with brown compact sections which have different shrinkage properties even without pre-sintering of one of the brown compact sections during the sintering process. It can therefore be alternatively provided that one or more of the brown compact sections, including the brown compact section to be pre-sintered, include or consist of different metal powders in the sense that the metal powders used differ in the type and/or size of the metal powder particles, in the metal powder material and/or with regard to the binders used. Different metal powders in this sense apply in particular when the metal powder particles are of different type and/or size, but also when only the binder used is different or is added in a different degree to the metal powder particles used.

In accordance with a second exemplary aspect of the invention, a method for manufacturing parts by metal injection molding is provided in which at least three brown compact sections are joined together and then jointly sintered in a sintering process. One of these brown compact sections is a connecting part that is joined together with at least two further brown compact sections before the sintering process. This brown compact section designed as a connecting part undergoes during the sintering process higher or lower shrinkage compared with the further brown compact sections, so that the at least two further brown compact sections are firmly connected to one another via the connecting part.

It can be provided here that the connecting part and the further brown compact sections consist of the same material and have substantially identical shrinkage properties. In this case, either the connecting part or the further brown compact sections are subjected before the sintering process to a pre-sintering process in which pre-shrinkage takes place. The method of the second aspect of the invention is however also implementable when a connecting part is used which due to its material composition has other shrinkage properties than the brown compact sections to be connected to one another. For example, it differs from the further brown compact sections in the type and/or size of the metal powder particles and/or in the metal powder material and/or in the binder used.

The connecting part is designed for example as an insert having two projections arranged substantially completely inside two corresponding recesses of the brown compact sections to be connected to one another. If the insert has a greater shrinkage than the brown compact sections to be connected to one another, it draws the sections towards one another during sintering, so that they undergo compression over a large area along their adjoining contact surfaces. If the insert has a lower shrinkage than the brown compact sections to be connected to one another, these brown compact sections exert a pressure on the projections of the insert during sintering, with the subsequent connection of the two components being assured primarily by the projections.

BRIEF DESCRIPTION OF THE DRAWINGS

In the following, the present invention is described in greater detail with reference to the figures of the accompanying drawing showing several exemplary embodiments.

DETAILED DESCRIPTION

Figure 1:
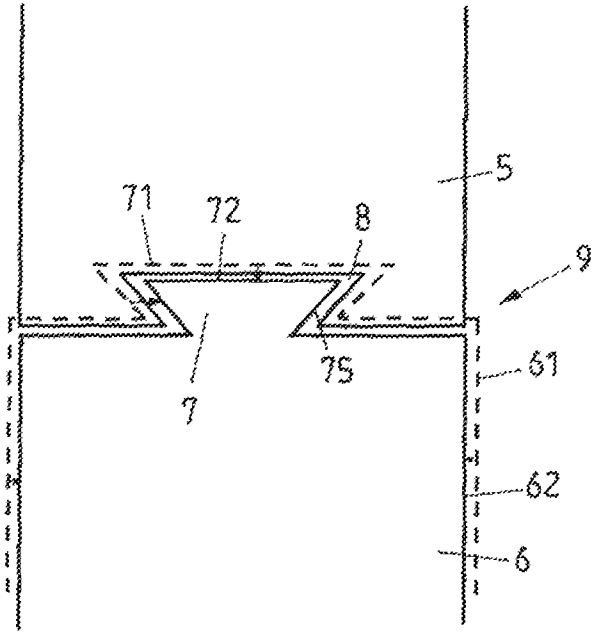
FIG. 1 schematically shows a first brown compact section with a projection and a second brown compact section with a recess, where the brown compact section provided with a projection has undergone a first shrinkage in a pre-sintering process.

FIG. 1 shows schematically two brown compact sections 5, 6. The two brown compact sections include or consist of identical materials, hence have the same shrinkage properties during a sintering process. For manufacturing the brown compact sections 5, 6, separate green compacts are created by metal injection molding of a metal powder (feedstock) mixed with a thermoplastic binder. The binder is then melted out of the green compacts in a furnace (debindering), so that brown compact sections 5, 6 having a porous material now are available.

The one brown compact section 6 has on its outer surface a projection 7. The projection 7 is however in the exemplary embodiment shown not necessarily designed dovetail-shaped. Its lateral surfaces 75 taper in the direction of the main body of the brown compact section 6.

The other brown compact section 5 has a recess 8 whose shape corresponds to that of the projection 7 and accordingly is also designed dovetail shaped. The projection 7 and the recess 8 represent positively engaging connecting elements of the two brown compact sections 5, 6. In other exemplary embodiments, the positively engaging connecting elements can also be provided in another way, for example having concave and convex shapes.

The brown compact sections 5, 6 connected to one another via the engaging connecting elements 7, 8 form a two-part brown compact 9.

It is now provided that the one brown compact section 6 is subjected, before positive connection to the brown compact section 5, to a pre-sintering process in which its volume shrinks from a first larger volume 61 to a second smaller volume 62. Accordingly, the outer dimensions of the projection 7 also shrink from a larger outer dimension 71 to a smaller outer dimension 72. The shrinkage process is shown schematically using arrows. The sizes of the projection 7 and of the recess 8 are matched to one another here such that the projection 7 cannot be moved into the recess 8 until it has been subjected to the pre-sintering process, whereas this was not possible before undergoing the pre-sintering process. For positive connection, the brown compact sections 5, 6 are moved longitudinally relative to one another, with the projection 7 positively engaging in the recess 8.

After pre-sintering of the brown compact section 6 and its connection to the non-pre-sintered brown compact section 5, the two brown compact sections 5, 6 are subjected to a main sintering process. Since the brown compact section 6 already underwent a first shrinkage in the pre-sintering process, it undergoes a lower shrinkage than the other brown compact section 5 during the main sintering process. As a result, the brown compact section 5 and the brown compact section 6 are firmly connected to one another. This connection is achieved such that the brown compact section 5, which shrinks more during the main sintering process, exerts a pressure on the projection 7. The resultant connection of the two components 5, 6 is primarily assured by the projections 7 and is limited by the cross-sectional surface (i.e. the basic surface of the projections).

Figure 2:
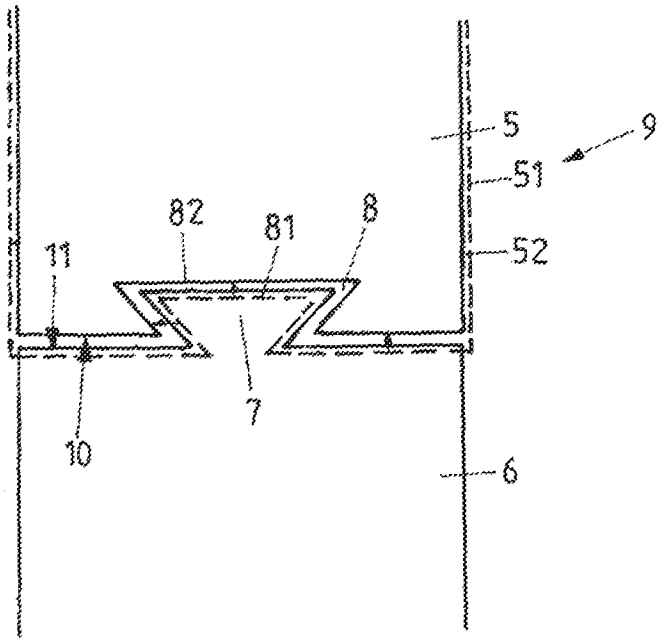
FIG. 2 schematically shows a first brown compact section with a projection and a second brown compact section with a recess, where the brown compact section provided with a recess has undergone a first shrinkage in a pre-sintering process.

FIG. 2 shows an alternative exemplary embodiment differing from the exemplary embodiment of FIG. 1 in that the brown compact section 5 having the recess 8 is subjected to a pre-sintering process and in so doing shrinks from a larger volume 51 to a smaller volume 52. Accordingly, the surface inside the recess changes from a surface 81 to a surface 82. After pre-sintering of the brown compact section 5, the two brown compact sections 5, 6 are positively connected to one another by their connecting elements 7, 8. This is followed by a main sintering process in which the two brown compact sections 5, 6 are simultaneously sintered.

In the exemplary embodiment in FIG. 2, the brown compact section 6 undergoes greater shrinkage, since it has not undergone pre-sintering. This leads to the two brown compact sections 5, 6 overall being drawn and pressed against one another, providing a close connection along all the contact surfaces 10, 11 of the two brown compact sections 5, 6. Accordingly, a high pressure and an intensive surface contact of the two brown compact sections 5, 6 are achieved not only in the area of the projections 7 and recesses 8, but rather along all the contact surfaces 10, 11 along which the two brown compact sections contact one another.

Figure 3:
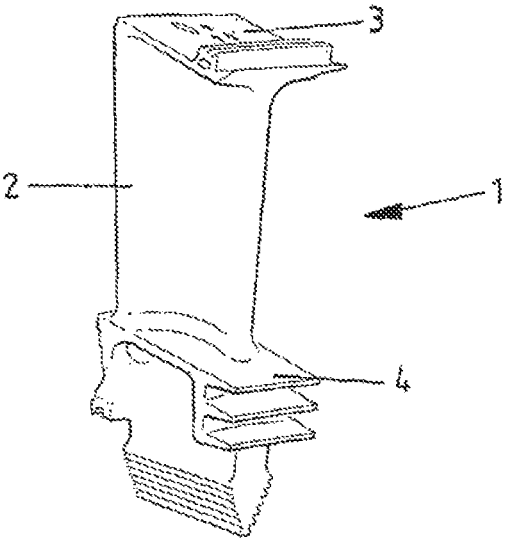
FIG. 3 shows an exemplary embodiment of a part manufactured in accordance with the present invention in the form of a turbine blade provided with an inner shroud and an outer shroud and composed of three separately manufactured brown compact sections.

FIG. 3 shows a possible exemplary embodiment of the technical teachings shown in FIGS. 1 and 2. An engine part of non-rotationally symmetrical design in the form of a turbine blade 1 is shown. The turbine blade 1 is joined together from three brown compact sections produced separately by metal injection molding and then sintered and connected to one another in a sintering process. The three sintered brown compact sections form an airfoil 2, an outer shroud 3 and an inner shroud 4 of the turbine blade 1.

For manufacturing the non-rotationally symmetrical engine part 1, separate green compacts of the outer and inner shrouds and of the airfoils are produced by metal injection molding of a metal powder (feedstock) mixed with a thermoplastic binder. The binder is melted out of the green compacts in a furnace (debindering), so that brown compact sections having a porous material are now available for the airfoil and for the inner and outer shrouds.

Figure 4:
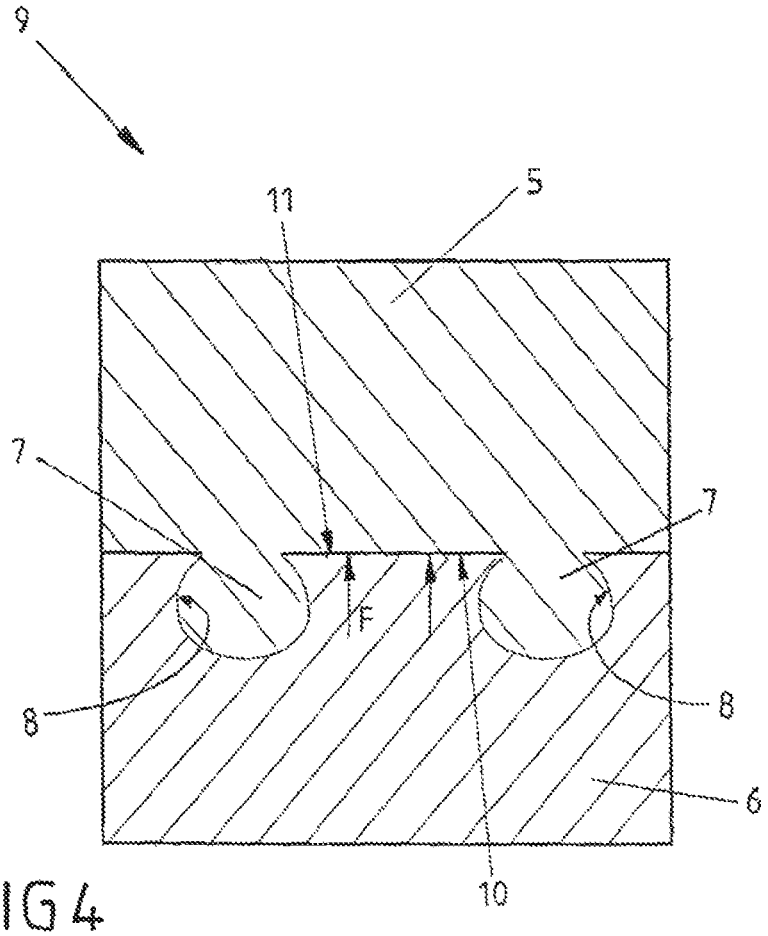
FIG. 4 shows a schematic representation of the joining area of a brown compact composed of two brown compact sections, with the state during the main sintering process being shown.

As shown by the joint illustrated in FIG. 4 between two separately produced outer and inner brown compact sections 5 and 6, approximately dovetail-shaped projections 7 tapering towards the contact surface 10 are located on the contact surface 10 of the one brown compact section 5 corresponding to the inner surface of the outer shroud 3 in FIG. 3, and approximately dovetail-shaped tapering recesses 8 are located on the contact surface 11 of the other brown compact section 6 corresponding to the upper edge of the airfoil 2 in FIG. 3. In the same manner, a further outer brown compact section (not shown)—intended for forming the inner shroud 4 of FIG. 3—is also provided with such projections which engage in recesses (not shown) provided on the lower edge of the inner brown compact section 6. Instead of dovetail-shaped tapering projections, projections tapering in another manner to the contact surface 10 can be alternatively provided.

The connecting elements created in the metal injection molding process in the form of projections 7 and recesses 8 engage positively in one another in the assembled brown compact 9, FIG. 4 shows that state after one of the two brown compact sections has already been pre-sintered and connected to the other brown compact section. The brown compact section 6 having the recesses 8 was pre-sintered in this way in the exemplary embodiment considered. This means that during subsequent joint sintering of the brown compact sections 5, 6 positively connected to one another by the recesses 8 and projections 7, the brown compact section 5 shrinks more. As a result of the fact that the brown compact section 5 shrinks more in the main sintering process, and as a result of the tapering form of the projections 7, the projections 7 draw the brown compact section 6 to the brown compact section 5, with the respective contact surfaces 10, 11 being pressed against one another. By doing so, a zero gap dimension is achieved between the contact surfaces 10, 11. The corresponding force acting on the brown compact section 6 and leading to a contact pressure between the two brown compact sections 5, 6 along the contact surfaces 10, 11 is indicated in FIG. 4 by arrows F.

The result of the sintering process is that an engine part of geometrically complicated structure produced by metal injection molding is provided.

The contact surfaces 10, 11 provided adjacent to the projections or recesses 7, 8 are designed substantially parallel in one embodiment, which includes their forming curved surfaces in the same manner. This ensures large-surface and intensive pressing during sintering.

Figure 5:
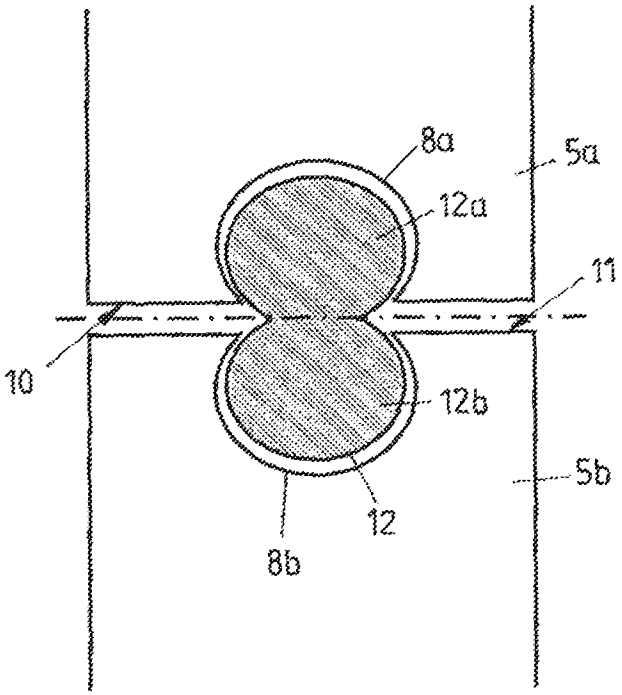
FIG. 5 schematically shows an exemplary embodiment, in which a first and a second brown compact section are connected to one another via a third brown compact section designed as an insert and having different shrinkage properties.

FIG. 5 shows an exemplary embodiment in which three brown compact sections 5*a*, 5*b* and 12 are connected to one another in a sintering process. The one brown compact section 12 is here designed in the form of an insert that has two circular or club-shaped projections 12*a*, 12*b* which are arranged in corresponding recesses 8*a*, 8*b* of the brown compact sections 5*a*, 5*b*.

The insert 12 acts as the connecting part for connecting the two brown compact sections 5*a*, 5*b* in a sintering process. It is provided here that the insert 12 when compared with the brown compact sections 5*a*, 5*b* undergoes a higher or a lower shrinkage during the sintering process. This can be achieved on the one hand in that the insert 12 has differing shrinkage properties due to a different material selection. For example, type and/or size of the metal powder particles are different and/or a different binder or a different amount of binder is used. Due to these inherent and differing material properties, the brown compact section 12 acting as the insert undergoes a different shrinkage during the sintering process.

A differing shrinkage of the insert 12 can however also be achieved in accordance with the exemplary embodiment of FIGS. 1 and 2 in that either the insert 12 or the brown compact sections 5*a*, 5*b* undergo pre-sintering, which also leads to the insert 12 and the brown compact sections 5*a*, 5*b* undergoing shrinkage in different ways during the main sintering process.

In one exemplary embodiment, it is provided that the insert 12 undergoes heavier shrinkage in the sintering process than the brown compact sections 5*a*, 5*b*. This leads—in line with the explanation for FIGS. 2 and 4—not only to the two brown compact sections 5*a*, 5*b* being firmly connected to one another via the insert 12, but also to the insert 12 drawing the brown compact sections 5*a*, 5*b* to one another so that they are pressed against one another along their contact surfaces 10, 11.

It is however also possible that the insert 12 undergoes shrinkage in the sintering process which is less than the shrinkage undergone by the brown compact sections 5*a*, 5*b*. In this case, a connection between the respective brown compact sections 5*a*, 5*b* and the insert 12 is substantially in the area of the projections 12*a*, 12*b*.

The previously described exemplary embodiments focused on the manufacture of non-rotationally symmetrical parts formed from two or more brown compacts designed with connecting elements. The invention is however not restricted to exemplary embodiments of this type. Proceeding from the idea of applying compression to the brown compact sections to be joined together by pre-shrinking a section in a pre-sintering process and by different shrinkage in a main sintering process, it is sufficient in the case of rotationally symmetrical parts, even without the connecting elements 7, 8 mentioned, when an outer brown compact section enclosing the inner brown compact section has greater shrinkage in the main sintering process, so that the separately produced rotationally symmetrical brown compact sections are firmly pressed against one another during sintering.

Finally, it is also possible to use an additional and more heavily shrinking brown compact as the tool to enclose the brown compact sections to be connected and to press them firmly against one another during joint sintering.

The present invention is not limited in its design to the exemplary embodiments explained in the above, which are only to be understood as examples. For instance, the shapes and dimensions of the recesses in the individual brown compact sections must be regarded only as examples. It can also be provided that brown compact sections to be connected to one another have a plurality of matching projections and recesses. Also the embodiment of an engine part described in FIG. 3 is to be understood merely as an example. The invention can be implemented for any parts, in particular engine parts, consisting of different components created by metal injection molding, allowing engine parts of geometrically complex structure to be manufactured.

The invention claimed is:

1. A method for manufacturing a part, comprising:

producing individual components of the part as separately molded green compact sections by metal injection molding of metal powder mixed with a binder, and then removing the binder from the green compact sections to form first, second and third debindered brown compact sections with the third brown compact section shaped to act as a connecting part to connect together the first and second brown compact sections;

subjecting one chosen from the third brown compact section, and the first and second brown compact sections to a pre-sintering process in which the one chosen from the third brown compact section, and the first and second brown compact sections undergoes a first shrinkage;

connecting to one another the first and second brown compact sections with the third brown compact section as the connecting part to form a multi-part brown compact, the other of the third brown compact section, and the first and second brown compact sections being non-pre-sintered when connected to the pre-sintered one chosen from the third brown compact section, and the first and second brown compact sections;

subsequently subjecting the multi-part brown compact to a main sintering process whereby the connected first, second and third brown compact sections undergo shrinkage, with the one pre-sintered one chosen from the third brown compact section, and the first and second brown compact sections undergoing a second shrinkage less than a shrinkage of the other of the third brown compact section, and the first and second brown compact sections to draw together and firmly connect to one another the first, second and third brown compact sections, thereby providing pressure on contact surfaces to be joined of the first, second and third brown compact sections;

connecting the first, second and third brown compact sections to one another before the main sintering process by positively engaging connecting elements provided on joining surfaces of the first, second and third brown compact sections, wherein the connecting elements of the first, second and third brown compact sections include:

a first one of a projection or a recess on the third brown compact section and a matching and complementary shape on the first brown compact section; and a second one of a projection or a recess on the third brown compact section and a matching and complementary shape on the second brown compact section;

providing the one chosen from the third brown compact section, and the first and second brown compact sections to be pre-sintered with dimensions such that, before being subjected to the pre-sintering process, the one chosen from the third brown compact section, and the first and second brown compact sections cannot be connected to the other of the third brown compact section, and the first and second brown compact sections, and during the pre-sintering process the one chosen from the third brown compact section, and the first and second brown compact sections shrinks sufficiently to permit connection to the other of the third brown compact section, and the first and second brown compact sections;

wherein the third brown compact section which is the connecting part draws the first and second brown compact sections against one another making contact during the main sintering process.

2. The method in accordance with claim 1, wherein the projection tapers towards the contact surfaces between the first and second brown compact sections and has at least one chosen from a dovetail and a club shape, and wherein the recess has a matching and complementary shape.

3. The method in accordance with claim 2, and further comprising providing the projection with a convex curvature and the recess with a concave curvature.

4. The method in accordance with claim 1, and further comprising providing the third brown compact section which is the connecting part with two projections acting as connecting elements.

5. The method in accordance with claim 1, and further comprising providing that the part has a rotationally symmetrical design where one of the first and second brown compact sections is an inner brown compact section and the other of the first and second brown compact sections is an outer brown compact section enclosing the inner brown compact section, and the third brown compact section is the pre-sintered piece and via the main sintering process the outer brown compact section is drawn together with the inner brown compact section by the third brown compact section.

6. The method in accordance with claim 1, wherein the first, second and third brown compact sections consist of a same material and have substantially identical shrinkage properties.

7. The method in accordance with claim 1, wherein the pre-sintered one chosen from the third brown compact section, and the first and second brown compact sections undergoes a volume shrinkage of at least 2% during pre-sintering.

* * * * *